US011421475B2

(12) United States Patent
Ballard et al.

(10) Patent No.: US 11,421,475 B2
(45) Date of Patent: Aug. 23, 2022

(54) ADJUSTMENT MECHANISMS, LADDERS INCORPORATING SAME AND RELATED METHODS

(71) Applicant: LITTLE GIANT LADDER SYSTEMS, LLC, Springville, UT (US)

(72) Inventors: Jay Ballard, Mapleton, UT (US); Benjamin L. Cook, Provo, UT (US); N. Ryan Moss, Mapleton, UT (US); Sean R. Peterson, Payson, UT (US)

(73) Assignee: LITTLE GIANT LADDER SYSTEMS, LLC, Springville, UT (US)

( * ) Notice: Subject to any disclaimer, the term of this patent is extended or adjusted under 35 U.S.C. 154(b) by 124 days.

(21) Appl. No.: 16/693,062

(22) Filed: Nov. 22, 2019

(65) Prior Publication Data

US 2020/0232277 A1 Jul. 23, 2020

Related U.S. Application Data

(63) Continuation of application No. 15/448,253, filed on Mar. 2, 2017, now Pat. No. 10,487,576.
(Continued)

(51) Int. Cl.
*E06C 1/22* (2006.01)
*E06C 7/42* (2006.01)
(Continued)

(52) U.S. Cl.
CPC ..... *E06C 1/22* (2013.01); *E06C 7/06* (2013.01); *E06C 7/426* (2013.01); *E06C 7/16* (2013.01)

(58) Field of Classification Search
CPC ..... E06C 7/06; E06C 7/16; E06C 1/22; E06C 7/423; E06C 7/426; E06C 7/44
See application file for complete search history.

(56) References Cited

U.S. PATENT DOCUMENTS 600,196 A 3/1898 Duryea
607,808 A 7/1898 Tiefel
(Continued)

FOREIGN PATENT DOCUMENTS

CN 2081878 U 7/1991
CN 2674056 Y 1/2005
(Continued)

OTHER PUBLICATIONS

Extended European Search Report for EP Application No. 17760858.5, dated Sep. 17, 2019.
(Continued)

*Primary Examiner* — Colleen M Chavchavadze
(74) *Attorney, Agent, or Firm* — Dorsey & Whitney LLP

(57) ABSTRACT

Ladders, ladder components and related methods are provided. In some embodiments, adjustable stepladders are provided which include locking mechanisms that enable height adjustment of the ladder through application of a force towards the rails of the ladder. The locking mechanism may include a base or bracket, a handle or lever pivotally coupled with the bracket, an engagement pin coupled with the lever, a biasing member to bias the handle towards a first position relative to the bracket, and a detent mechanism for retaining the lever in at least a second position relative to the bracket.

16 Claims, 9 Drawing Sheets

Related U.S. Application Data

(60) Provisional application No. 62/303,588, filed on Mar. 4, 2016.

(51) Int. Cl.
*E06C 7/06* (2006.01)
*E06C 7/16* (2006.01)

(56) References Cited

U.S. PATENT DOCUMENTS 622,831 A 4/1899 Wallach et al.
656,946 A 1/1900 Corduan et al.
933,816 A 9/1909 Bartos et al.
992,915 A 5/1911 Shaw
1,068,805 A 7/1913 Mosiman
1,379,419 A 5/1921 Reeves
1,397,280 A 11/1921 Graf
2,167,157 A 7/1939 Muehlberg
2,310,441 A * 2/1943 Klum ..... E06C 1/12 182/213
2,680,555 A * 6/1954 Nilsson ..... E06C 1/12 182/211
2,827,216 A 3/1958 Napolitano
2,937,842 A 5/1960 Meek
2,975,857 A 3/1961 Suroff et al.
3,057,431 A 10/1962 Russel
3,858,684 A 1/1975 Goings
4,210,224 A 7/1980 Kummerlin et al.
4,226,302 A 10/1980 Roche
4,407,045 A 10/1983 Boothe
4,574,918 A 3/1986 Marques
4,754,845 A 7/1988 Baker
4,826,059 A 5/1989 Bosch et al.
5,074,377 A 12/1991 Krause
5,098,052 A 3/1992 Beck
5,120,013 A 6/1992 Sweeney
5,203,596 A 4/1993 Stevens
D341,895 S 11/1993 Idh
5,353,892 A 10/1994 Lu
5,495,915 A * 3/1996 Weston ..... E06C 1/125 182/195
5,577,574 A 11/1996 Joseph
D388,882 S 1/1998 Kain
5,722,507 A 3/1998 Kain
5,740,883 A 4/1998 Trank
5,913,380 A 6/1999 Gugel et al.
5,967,260 A 10/1999 Spak
6,073,726 A 6/2000 McCrystal
6,116,379 A 9/2000 Huss
6,220,389 B1 * 4/2001 Krause ..... E06C 1/12 182/163
6,422,341 B1 * 7/2002 Engdahl ..... E06C 7/16 182/103
6,454,050 B2 9/2002 Gibson et al.
6,587,022 B1 7/2003 Devine
6,607,053 B1 8/2003 Warren
6,614,337 B1 9/2003 Winnard
6,637,548 B2 10/2003 Pass
6,698,550 B2 3/2004 Crain
6,698,699 B1 3/2004 Bailey
6,874,598 B1 4/2005 Baker
6,986,405 B2 1/2006 Meeker
6,997,282 B1 2/2006 Sharp et al.
7,000,732 B1 2/2006 Briggs, Jr.
7,032,711 B1 4/2006 Katz et al.
7,097,380 B2 * 8/2006 Lee ..... F16B 7/105 15/80
7,114,592 B1 10/2006 Gibson et al.
7,128,187 B2 10/2006 Simpson
7,310,035 B2 12/2007 Wooten
D576,290 S 9/2008 Meyers et al.
7,849,967 B2 12/2010 Gibson et al.
7,931,123 B2 4/2011 Moldthan et al.
8,042,653 B2 10/2011 Grebinoski
8,128,306 B2 * 3/2012 Gorza ..... B62K 19/36 403/109.3
8,186,481 B2 * 5/2012 Moss ..... E06C 1/18 182/129
2002/0084143 A1 7/2002 Roy
2004/0200669 A1 10/2004 Saccente et al.
2004/0238278 A1 12/2004 Gibson et al.
2005/0121261 A1 6/2005 Moss et al.
2005/0127254 A1 6/2005 Scott et al.
2005/0186023 A1 8/2005 Lee
2006/0006024 A1 1/2006 Till
2006/0124397 A1 6/2006 Vosbein-jensen
2006/0169539 A1 8/2006 Grebinoski et al.
2006/0249331 A1 11/2006 Meeker
2007/0062007 A1 3/2007 Osborne et al.
2007/0120028 A1 5/2007 Kane
2007/0181368 A1 8/2007 Simpson
2007/0181369 A1 8/2007 Gibson et al.
2009/0078503 A1 3/2009 Eriksson
2009/0229918 A1 9/2009 Moss et al.
2009/0283361 A1 11/2009 Gibson et al.
2010/0080650 A1 4/2010 Gorza
2010/0282540 A1 11/2010 Moss et al.
2011/0011678 A1 1/2011 Sheffield
2011/0127110 A1 6/2011 Trang
2012/0211305 A1 8/2012 Moss et al.
2012/0324701 A1 12/2012 Dangrow et al.
2015/0068842 A1 3/2015 Moss et al.
2015/0267468 A1 9/2015 Moss et al.
2016/0023347 A1 1/2016 Ho
2017/0058930 A1 3/2017 Liu
2018/0094485 A1 * 4/2018 Carrera ..... E06C 7/06

FOREIGN PATENT DOCUMENTS

CN 101050687 A 10/2007
CN 105221063 A 1/2016
CN 105221064 A 1/2016
CN 105221065 A 1/2016
DE 4403001 A1 8/1994
EP 2169175 A1 3/2010
GB 685757 A * 1/1953 ..... E06C 1/12
GB 685757 A 1/1953
GB 2305956 A 4/1997
JP 10088949 A 4/1998
JP 2000054616 A 2/2000
KR 200146389 Y1 6/1999
KR 200412244 Y1 3/2006
NL 7614042 A 6/1977
WO 9902915 A1 1/1999

OTHER PUBLICATIONS

PCT Written Opinion and International Search Report for PCT International Patent Application No. PCT/US2017/020540, dated May 26, 2017.

* cited by examiner

ADJUSTMENT MECHANISMS, LADDERS INCORPORATING SAME AND RELATED METHODS

CROSS-REFERENCE TO RELATED APPLICATIONS

The present application is a continuation of U.S. application Ser. No. 15/448,253, filed Mar. 2, 2017, now issued as U.S. Pat. No. 10,487,576, which claims the benefit of U.S. Provisional Application No. 62/303,588 filed on Mar. 4, 2016, the disclosures of which are incorporated by reference herein in their entireties.

BACKGROUND

Ladders are conventionally employed to provide a user thereof with improved access to locations that might otherwise be inaccessible. Ladders come in many shapes and sizes, such as straight ladders, straight extension ladders, stepladders, and combination step and extension ladders.

So-called combination ladders are particularly useful because they incorporate, in a single ladder, many of the benefits of other ladder designs. However, the increased number of features provided by a combination ladder also brings added complexity to the operation of the ladder, the manufacture of the ladder, or both.

In one example, the height of the a combination ladder may be adjusted by actuating locking members (sometimes referred to as "lock tabs") on the sides of the ladder. The action of actuating such locking members usually requires a lateral displacement of the locking members outward, or away from, the side rails of the ladders. Such an action can be awkward and difficult for some people to perform. In many cases, such as when smaller users are trying to adjust the height of the ladder, significant effort may be required.

In an effort to address such a concern, various approaches have been taken including those described in U.S. Pat. No. 8,186,481, entitled LADDERS, LADDER COMPONENTS AND RELATED METHODS, issued on May 29, 2012, the disclosure of which is incorporated by reference herein in its entirety. The locking mechanism described therein provides improved ergonomics and functionality of the ladder.

Sometimes, added features, such as the locking mechanism described in the above-references U.S. Patent, introduces complexity into a design that may increase the cost and time to manufacture and, thus, the driving up the ultimate cost to consumers. Further, added complexity may introduce additional potential failure points where an increased number of components may be subject wear or fail due to repeated use.

Considering the desire within the industry to continually improve the safety, functionality and efficiency of ladders, the present disclosure provides embodiments related to enhanced ease of use, ease of manufacturability, stability and safety in the use of ladders, among other things.

BRIEF SUMMARY OF THE INVENTION

Ladders, ladder components and related methods are provided in accordance with various embodiments of the present invention. In one embodiment, a ladder comprises a first assembly having a pair of inner rails and a pair of outer rails, the pair of inner rails being slidably coupled with the pair of outer rails and at least one locking mechanism. The locking mechanism includes a bracket coupled with a first outer rail of the pair of outer rails, a lever pivotally coupled with the bracket, an engagement pin coupled with the lever and having an engagement portion sized and configured to engage an opening formed in the first outer rail and an aligned opening formed in a first inner rail of the pair of rails, a biasing member biasing the lever towards a first position, and a detent mechanism. The detent mechanism comprises a slider body slidably disposed in a detent pocket formed within an interior portion of the lever, a detent spring disposed within the detent pocket and biasing the slider body in a first direction, and a detent groove formed in a portion of the bracket. The detent mechanism is configured such that when the lever is pivoted to a second position relative to the bracket, a portion of the slider body is biased into engagement with the detent groove by the detent spring, maintaining the lever in the second position until a predetermined force is applied to a specified portion of the lever.

In one embodiment, the engagement pin further includes a lever portion extending downward from the engagement portion, the lever portion including a grooved surface, the grooved surface of the lever portion pivotally engaging a pivot structure of the bracket.

In one embodiment, the engagement pin further includes a hook portion extending away from the engagement portion, the hook portion engaging a groove formed in the lever.

In one embodiment, the locking mechanism further comprises a retaining plate coupled with the lever adjacent the slider body, the retaining plate located and configured to retain the slider body within the detent pocket.

In one embodiment, the locking mechanism further comprises a pivot pin coupling the lever to the bracket.

In one embodiment, the ladder further comprises at least one rung coupled between the pair of inner rails and at least one rung coupled between the pair of outer rails.

In one embodiment, the at least one locking mechanism includes a first locking mechanism associated with the first outer rail of the pair of outer rails and a second locking mechanism associated with a second outer rail of the pair of outer rails.

In one embodiment, the ladder further comprises a top cap coupled with the first assembly; and a second assembly coupled with the top cap, wherein at least one of the first assembly and the second assembly is pivotably coupled with the top cap.

In one embodiment, the second assembly includes a pair of outer rails and a pair of inner rails slidably coupled with the pair of outer rails.

In one embodiment, the second assembly includes a pair of outer rails and a pair of inner rails slidably coupled with the pair of outer rails.

In one embodiment, the lever pivots relative to the bracket about a first axis and wherein the engagement pin pivots about a second axis relative to the bracket. In one embodiment, the first axis and the second axis are parallel to one another.

In one embodiment, the engagement pin includes a shoulder portion adjacent the engagement portion, the shoulder portion having a protruding edge that engages an opening in an outer rail when the locking mechanism is in the first position.

In accordance with another embodiment of the present disclosure, a ladder is provided that comprises a first assembly having a pair of inner rails and a pair of outer rails, the pair of inner rails being slidably coupled with the pair of outer rails, and at least one locking mechanism. The at least one locking mechanism comprises: a bracket coupled with a first outer rail of the pair of outer rails, a lever pivotally coupled with the bracket at a first pivot point, and an engagement pin coupled with the lever. The engagement pin is also being pivotally coupled with the bracket at a second pivot point. The engagement pin includes an engagement portion sized and configured to engage an opening formed in the first outer rail and an aligned opening formed in a first inner rail of the pair of rails.

In one embodiment, the at least one locking mechanism further includes a biasing member in contact with a portion of the lever and in contact with a portion of the engagement pin.

In one embodiment, the at least one locking mechanism further includes a detent mechanism comprising: a slider body slidably disposed in a detent pocket formed within an interior portion of the lever; a detent spring disposed within the detent pocket and biasing the slider body in a first direction; a detent groove formed in a portion of the bracket, wherein when the lever is pivoted to a second position relative to the bracket, a portion of the slider body is biased into engagement with the detent groove by the detent spring such that the lever is maintained in the second position until a predetermined force is applied to a specified portion of the lever.

In one embodiment, the first direction is substantially perpendicular to an axis of rotation of the lever relative to the bracket.

In one embodiment, the biasing member engages lever at a location between the first pivot point and the detent pocket.

In one embodiment, the lever pivots relative to the bracket about a first axis and wherein the engagement pin pivots about a second axis relative to the bracket, and wherein the first axis and the second axis are parallel to one another.

In one embodiment, the second pivot point is positioned closer to the first outer rail than the first pivot point.

In one embodiment, the first pivot point is at an upper portion of the bracket and the second pivot point is at a lower portion of the bracket.

In one embodiment, the engagement pin includes a hook portion engaging an opening formed in the lever.

In one embodiment, the engagement pin includes a shoulder portion adjacent the engagement portion, the shoulder portion having a protruding edge that engages an opening in an outer rail when the locking mechanism is in a first or engaged position.

BRIEF DESCRIPTION OF THE SEVERAL VIEWS OF THE DRAWINGS

The foregoing and other advantages of the invention will become apparent upon reading the following detailed description and upon reference to the drawings in which.

DETAILED DESCRIPTION OF THE INVENTION

Figure 1:
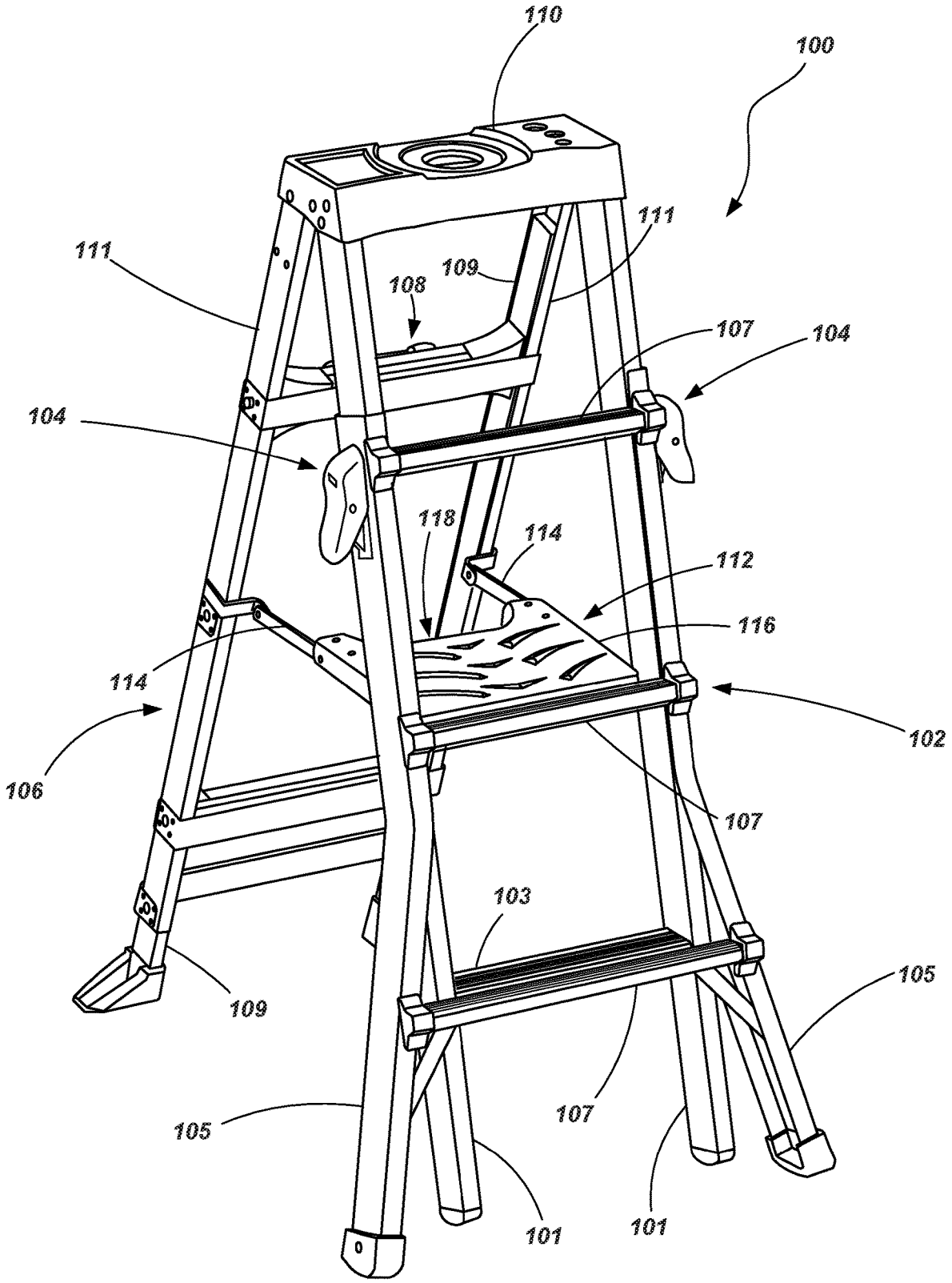
FIG. 1 is a perspective view of a ladder in accordance with an embodiment of the present invention.
Figure 2:
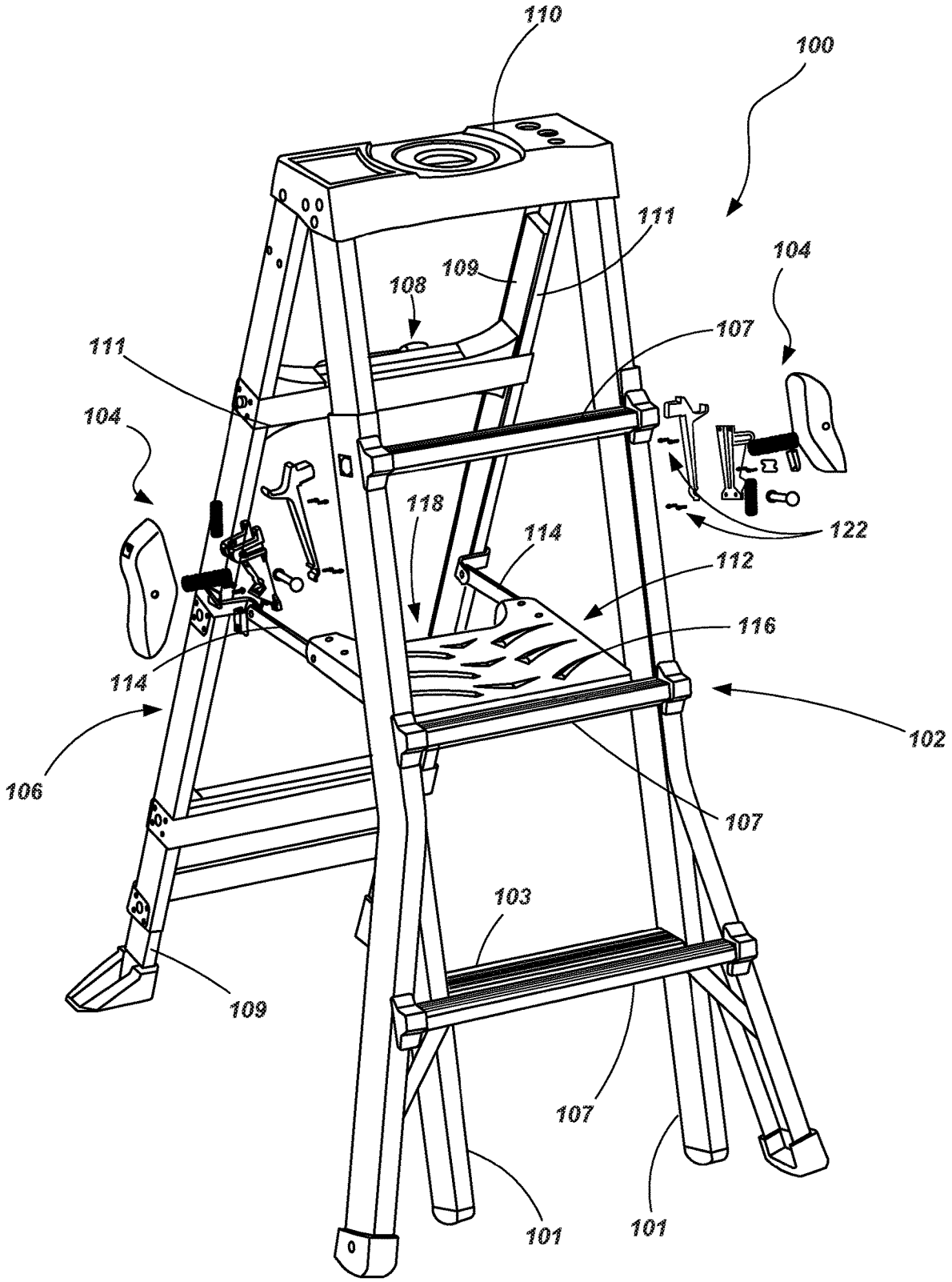
FIG. 2 is a perspective view of the ladder shown in FIG. 1 with an adjustment mechanism shown in an exploded view.

Referring to FIGS. 1 and 2, a ladder 100 is shown in accordance with an embodiment of the present invention. The ladder 100 is shown as a stepladder and includes a first assembly 102 including inner rails 101 and one or more rungs 103 extending between, and coupled to, the inner rails 101. The first assembly 102 further includes outer rails 105 and one or more rungs 107 extending between, and coupled to, the outer rails 105. The inner and outer rails 101 and 105 are slidably connected to each other such that the first assembly 102 may be extended or retracted to exhibit different heights. One such assembly is described in U.S. Pat. No. 4,210,224 to Kummerlin, the disclosure of which is incorporated by reference herein in its entirety. The first assembly 102 further includes a locking mechanism 104 coupled with the outer rails 105 and configured to engage or release the inner rails 101 from the outer rails 105 so that they may be selectively displaced relative to one another and effect different ladder heights. The locking mechanism 104 will be discussed in further detail hereinbelow.

The ladder 100 further includes a second assembly 106 which may also include inner rails 109 and outer rails 111 slidingly coupled to one another. In the embodiment shown, the second assembly 106 includes cross bracing to stiffen the second assembly 106 and provide desired structural rigidity. However, in the embodiment shown in FIGS. 1 and 2, the second assembly 106 does not include rungs for a user to climb on. Such a configuration is conventional for many stepladder configurations. However, it is noted that in other embodiments, the second assembly 106 may include rungs and may be configured, for example, similar to the first assembly 102.

Another locking mechanism 108 may be used to selectively lock and release the inner rails 109 relative to the outer rails 111 of the second assembly 106. In one embodiment, the locking mechanism 108 associated with the second assembly 106 may be configured such as described in previously incorporated U.S. Pat. No. 8,186,481. In other embodiments, one or more locking mechanisms similar to the locking mechanism 104 associated with the first assembly 102 may be used with the second assembly 106.

The first and second assemblies 102 and 106 may each be coupled to a top cap 110. One of the first and second assemblies 102 and 106 (or both) may be configured to pivot relative to the top cap 110 such that the assemblies 102 and 106 may be displaced toward each other for compact storage and as will be appreciated by those of ordinary skill in the art. The top cap 110 may include a number of features to enhance the efficiency and usability of the ladder 100 such as described in the previously incorporated U.S. Pat. No. 8,186,481.

The ladder 100 further includes a spreader mechanism 112 coupled between the first and second assemblies 102 and 106 which extends therebetween to provide desired structural stability to the ladder 100 when in use, while also being configured to fold, such as by pivots or hinges, enabling the first and second assemblies 102 and 106 to collapse toward one another (with at least one of the assemblies 102 and 106 pivoting relative to the top cap 110) to place the ladder 100 in a stored state.

In the embodiment shown, the spreader mechanism 112 includes a pair of struts 114 or other members that are pivotally coupled with the second assembly 106 (e.g., pivotally coupled with the outer rails 111 either directly or by way of a bracket). The spreader mechanism 112 further includes a platform 116 or step that has one end pivotally coupled with the first assembly 102 and a second end pivotally coupled with the pair of struts 114. The platform 116 may include a handle 118 for a user to grasp and lift upwards in order to effect the folding of the spreader mechanism 112 and, thus, the collapsing or folding of the two assemblies 102 and 106 relative to one another. The platform 112 is located and positioned so that it extends inwardly from a rung 107 associated with the outer rails 105, a rung 103 associated with the inner rails 101, or both. In one embodiment, the platform 116 may take the place of a rung 103 associated with the inner rails 101 (e.g., the uppermost rung 103 associated with the inner rails 101 of the first assembly 102). Thus, the platform 116 provides an expanded area for a user to stand on when standing at the height of the spreader mechanism 112. Of course other spreader mechanisms may be employed including conventional mechanism as well as the spreader mechanism described in previously incorporated U.S. Pat. No. 8,186,481.

Figure 3:
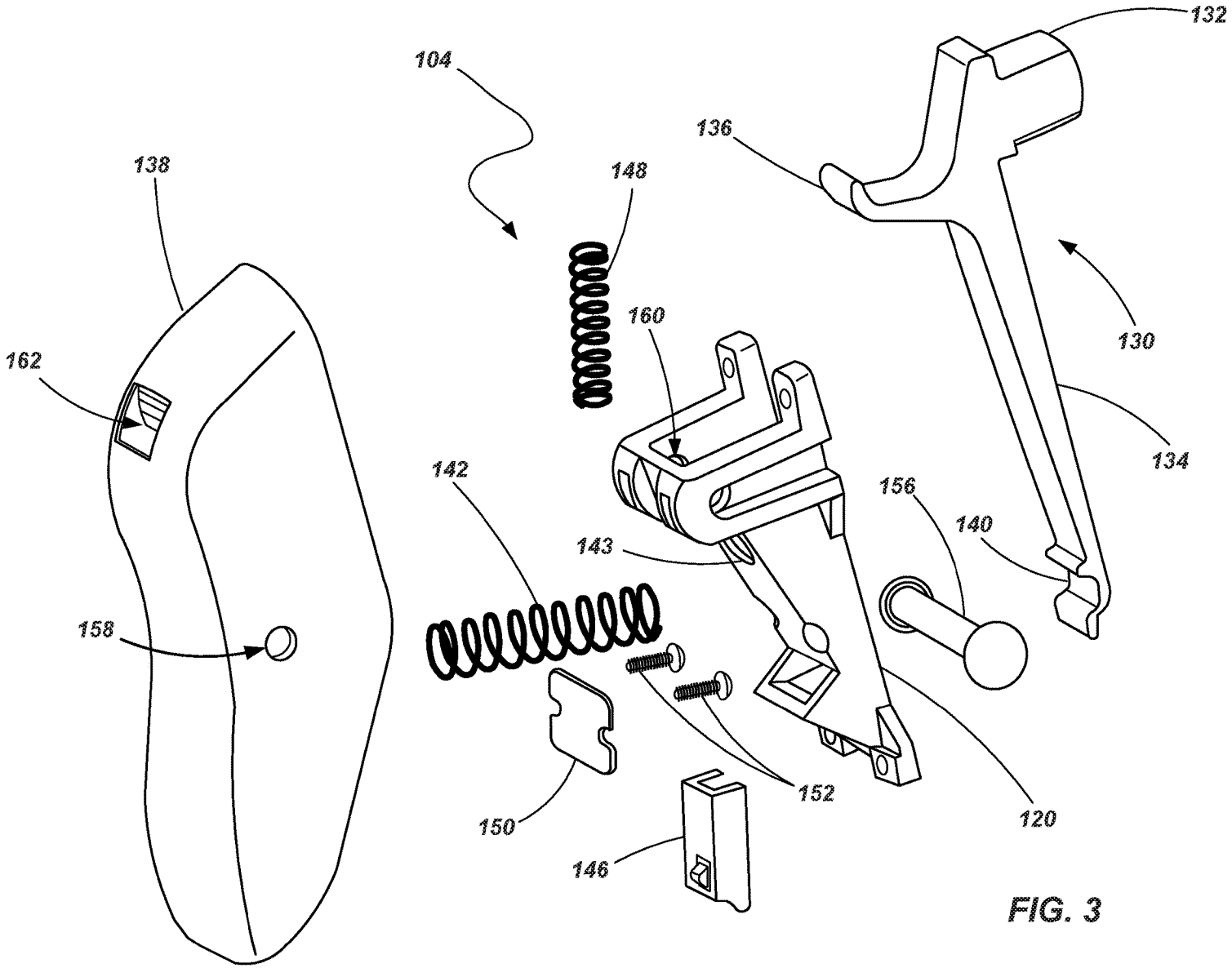
FIG. 3 is a an enlarged exploded view of the adjustment mechanism of FIG. 2.
Figure 4:
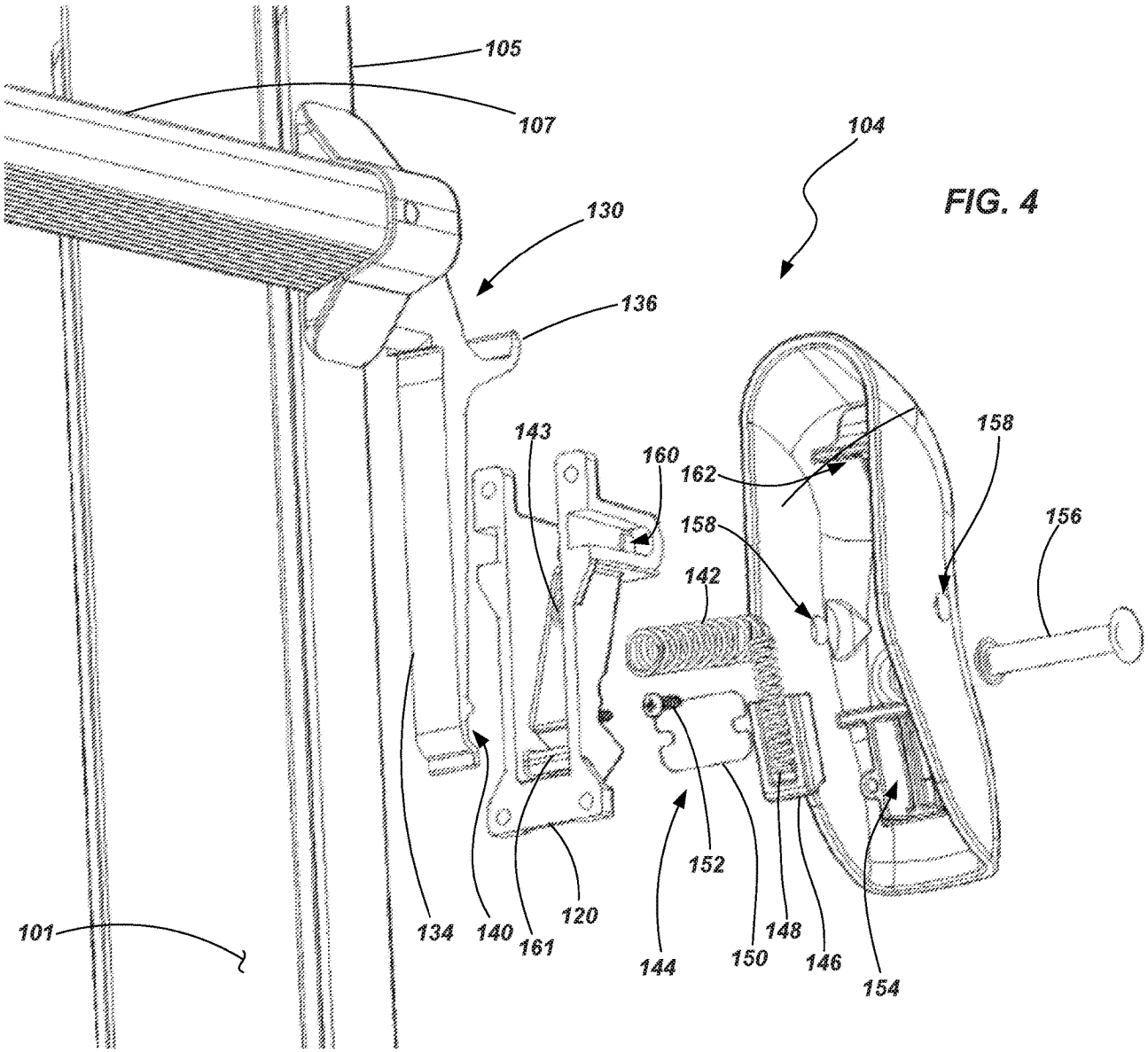
FIG. 4 is an enlarged, rotated, exploded view of the adjustment mechanism of FIG. 2.
Figure 5:
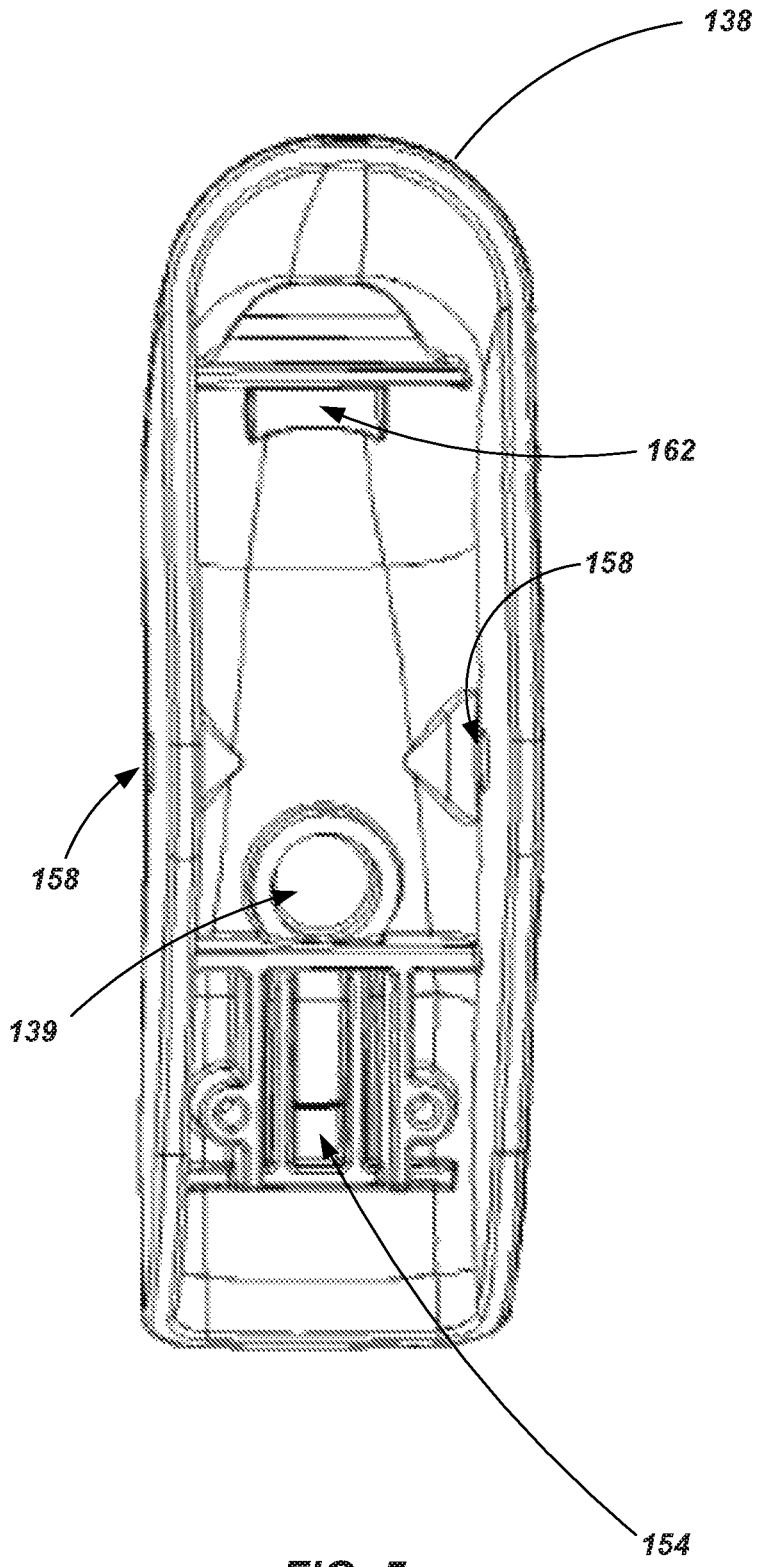
FIG. 5 is a component of the adjustment mechanism showing features formed on an inside surface thereof.

Referring now to FIGS. 3-5, a locking mechanism 104 is shown. FIG. 3 shows an exploded view of a locking mechanism 104 according to an embodiment of the present invention. FIG. 4 shows a rotated, exploded view of the locking mechanism. FIG. 5 shows an interior portion of one of the components of the locking mechanism 104 as discussed in further detail below.

The locking mechanism 104 includes a base member or a bracket 120 that is coupled to an associated outer rail 105 of the first assembly 102. In one embodiment, the bracket 120 may be coupled by way of rivets 122 (FIG. 2), screws, bolts or other mechanical fasteners. In other embodiments, the bracket may be coupled with the rail 105 by way of adhesive, by welding or other material joining techniques, or by other appropriate mechanical joining techniques.

The locking mechanism 104 further includes an engagement pin 130 having an engagement portion 132 and a lever portion 134 that extends downward from the engagement portion 132. The engagement pin 130 further includes a hook portion 136 extending outwardly away from the pin portion 132. The hook portion 136 is configured to engage with a corresponding feature formed in a handle or lever 138 as will be discussed in further detail below. The lower end of the lever portion 134 includes a grooved end 140 configured to engage a portion of the bracket 120 as will also be discussed in further detail below.

The locking mechanism 104 includes additional internal working components such as a biasing member, shown as a coil spring 142, that is positioned between a portion of the lever 138 (e.g., an end of the spring 142 may be disposed in a pocket 139 formed in the handle), and may extend through an opening 143 in the bracket 120 to engage a portion of the pin 130 (e.g., a portion of the lever portion 134). The coil spring 142 or other biasing member provides a biasing force between the lever 138 and the engagement pin 130, which is increased when the lever 138 (and pin 130) transitions from a first position (i.e., a closed or engaged state) to a second position (i.e., an open or disengaged state) as will be discussed below.

Additionally, the locking mechanism 104 includes a detent mechanism 144 configured to maintain the lever 138 and associated engagement pin 130 in a second position (e.g., wherein the pin portion 132 is disengaged from the inner rail 101 and/or the outer rail 105) until a desired level of force is applied to the lever 138. In the embodiment shown, the detent mechanism 144 includes a slider body 146, a detent spring 148 or other biasing member, and a retainer plate 150 with associated fasteners 152. The retainer plate 150 and fasteners hold the slider body 146 and detent spring 148 slidably within a pocket 154 formed within an interior portion of the lever 138 (i.e., a portion that is not exposed to a user when assembled).

A pivot member 156 (e.g., a pin) extends through openings 158 formed in the lever 138 as well as through openings 160 formed in the bracket 120. When assembled, the lever 138 rotates or pivots about the pivot member 156 between the first, engaged position and the second, disengaged position. As noted above, the lever 138 is biased towards the first, engaged position. The engagement pin 130 is coupled with the lever 138 such that when the lever rotates or pivots from its first position to its second position, engagement pin 130 also pivots or rotates relative to the bracket 120 from a first position to a second position, although it pivots about a different pivot point than does the lever 138 as will be discussed in further detail below. When the engagement pin 130 pivots from its first position to its second position, the pin portion 132 disengages the inner rail 101 of the first assembly 102 enabling the associated outer rail 105 to slide relative to the associated inner rung 101 such that the height of the first assembly 102 may be adjusted.

Figure 6:
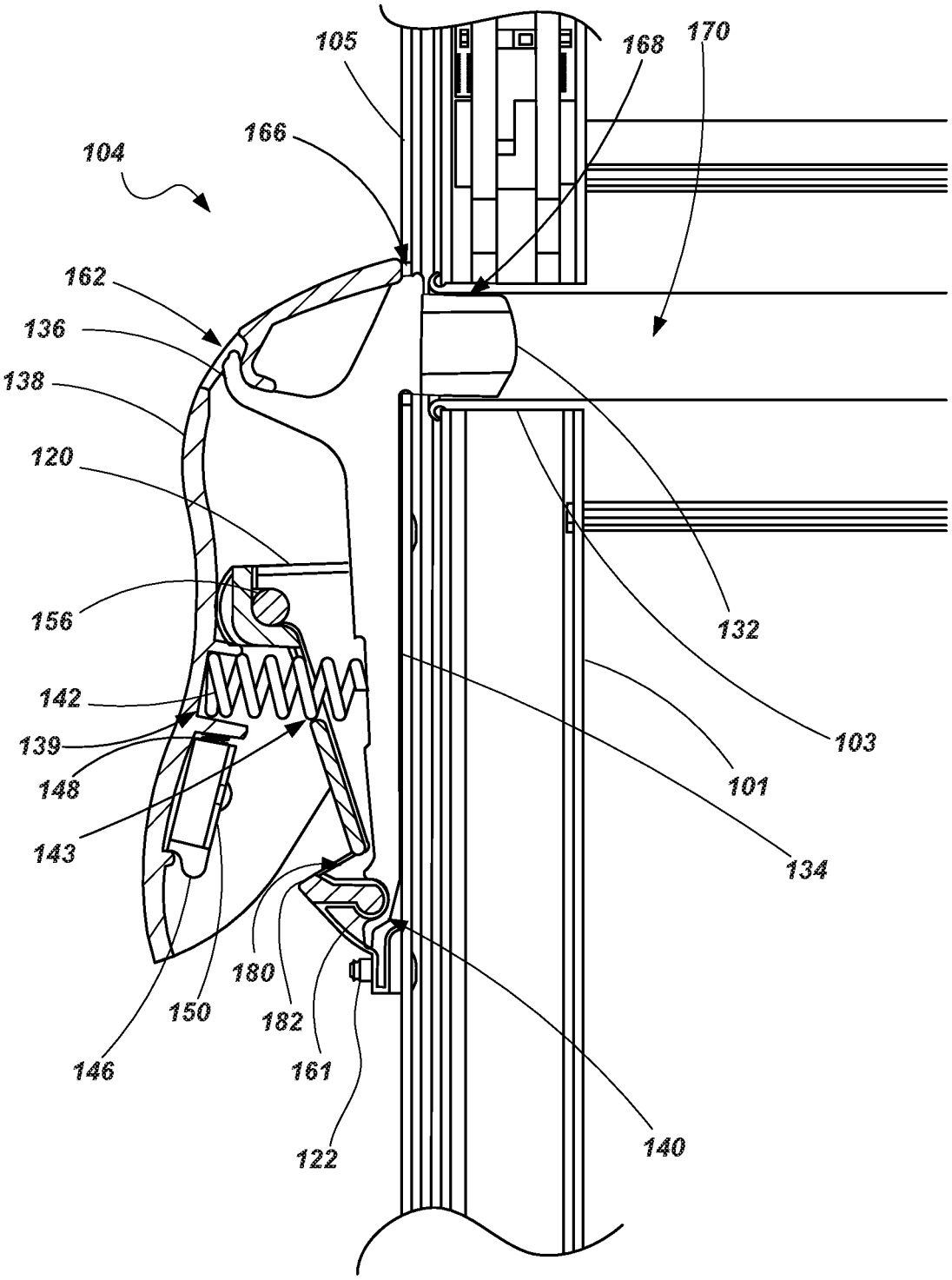
FIG. 6 is a partial cross-sectional view of an adjustment mechanism while in a first state or position.
Figure 7:
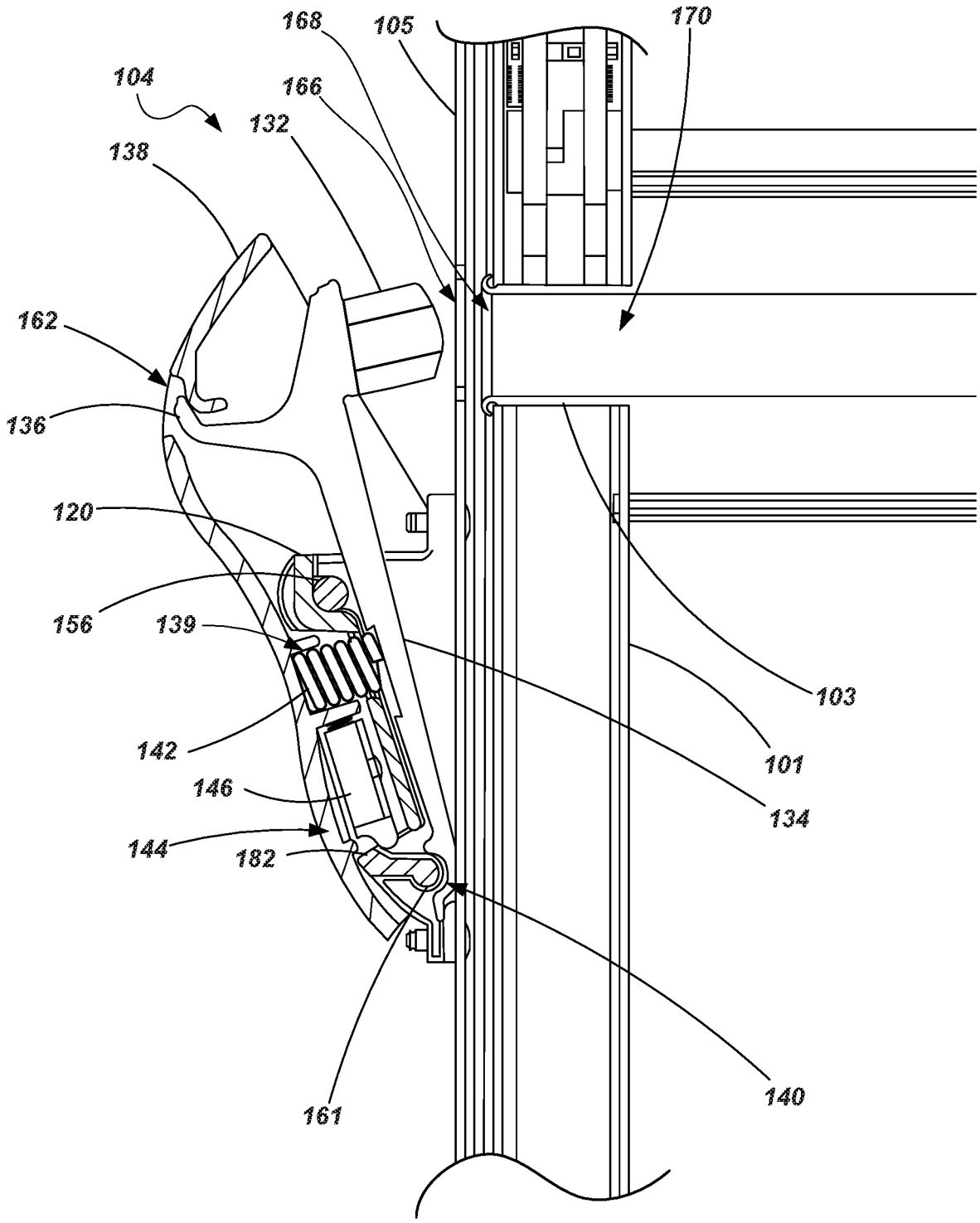
FIG. 7 is a partial cross-sectional view of an adjustment mechanism while in a second state or position.

Referring to FIGS. 6 and 7, a partial cross-sectional view of an assembled locking mechanism 104 is shown with the locking mechanism 104 in the first, engaged position in FIG. 6 and the locking mechanism is shown in the second, disengaged position in FIG. 7. As seen in FIGS. 6 and 7, the grooved end 140 of the lever portion 134 engages a pivot structure 161 formed in the bracket 120 (e.g., a rounded shoulder or shaft-like structure). Additionally, the hook portion 136 of the engagement pin 130 engages a slot or other engagement structure 162 formed in the handle or lever 138, coupling the engagement pin 130 with the lever 138 so that they pivot together as a unit about the pivot member 156.

It is noted that while the engagement pin 130 and lever 138 may be stated as pivoting together as a unit, the two components actually pivot about different axes relative to the bracket 120. For example, as seen in comparing FIGS. 6 and 7, and as has been previously discussed, the lever 138 pivots about a first pivot point (e.g., pivot pin 156) while the engagement pin 130 pivots about a second pivot point (e.g., pivot structure 161). In one embodiment, as shown in FIGS. 6 and 7, the two pivot points are positioned along parallel axes with the second pivot point (e.g., pivot structure 161) being lower than the first pivot point (e.g., pivot member 156) and the second pivot point being positioned closer to the rail 105 of the ladder 100 than the first pivot point.

When the locking mechanism 104 is in in the first, engaged position, as shown in FIG. 6, the pin portion 132 extends through an opening 166 formed in the outer rail 105 of the first rail assembly 102, through an opening 168 of the inner rail 101 and, optionally, into an interior portion 170 of a rung 103 associated with the inner rails 101. Thus, with the locking mechanism 104 in the first, engaged position, the pin portion 132 prevents the inner rail 101 from sliding relative to the outer rail 105 due to its engagement with the aligned openings or apertures 166 and 168. In the embodiment depicted in FIGS. 6 and 7, the coil spring 142 is positioned below the pivot member 156 and biases the lever 138 and engagement pin 130 towards the first, engaged position.

When the locking mechanism 104 is in in the second, disengaged position, as shown in FIG. 7, the pin portion 132 is displaced out of contact with at least the inner rail 101 of the first assembly 102. Further the pin portion 132 may be displaced such that it does not contact or engage the outer rail 105 of the first assembly 102. When in this second, disengaged position, the slider body 146 of the detent mechanism 144 is pressed downward within the pocket 154 by the detent spring 148 such that the lower end of the slider body engages a detent slot or groove 180 formed in the bracket 120, maintaining the locking mechanism 104 in the second position despite the increased biasing force applied by the compressed coil spring 142. The locking mechanism 104 thus stays in the second position until, for example, a force is applied to the upper portion of the lever (i.e., above the pivot member 156) sufficient to cause the slider body 146 to be displaced upwards within the pocket 154, overcoming the force of the detent spring 148, such that the slider body 146 is released from the detent groove 180, enabling the lever 138 and engagement pin 130 to rotate back to the first position. The lower portion of the slider body 146 may angled or rounded to effect engagement with the detent groove 180 and movement over its associated shoulder 182 (i.e., as it contacts and slides over), causing the slider body 146 to be displaced within the detent pocket 154 as the locking mechanism 104 transitions between its first and second positions.

Thus, when a user desires to displace the inner and outer rails 101 and 105 of the first assembly 102 relative to each other, the user may, for example, grasp the lower portion of the lever 138 (i.e., the portion below the pivot member 156) in their palm, grab a portion of the outer rails 105 (and, optionally the inner rails 101) with their fingers, and squeeze so as to displace the lower portion of the lever 138 towards the outer rails 105 and thereby displace the upper portion of the lever 138 (and, thus, the engagement pin 130) away from the inner and outer rails 101 and 105 such that it is disengaged at least from the aperture or opening formed in the inner rails 101 and placing the locking mechanism in the second position (as shown in FIG. 7). The locking mechanism then stays in this position, regardless of whether or not openings 168 formed in the inner rails 101 and openings 166 formed in the outer rails 105 are aligned.

When both of the locking mechanisms 104 of a ladder 100 are in the second, disengaged position, the inner rails 101 may slide relative to the outer rails in order to adjust the height of the first assembly 102. Multiple spaced openings may be formed in the inner rails 101 (e.g., at locations that correspond with the rungs 103 associated with the inner rails 101) so that the first assembly may be adjusted at specified increments of height. When it is desired to place the locking mechanism(s) 104 in the first, engaged position, a user may grasp the upper portion of the lever 138 with their palm, a portion of the outer rails 105 (and/or the inner rails 101) with their fingers, and apply a force sufficient to overcome the retention force of the detent mechanism. The coil spring 142 will then assist in rotating the lever 138 and engagement pin 130 back into engagement with an opening formed in the inner rail 101, again preventing the inner rails 101 from being slidingly displaced relative to the outer rails 105.

Figure 8:
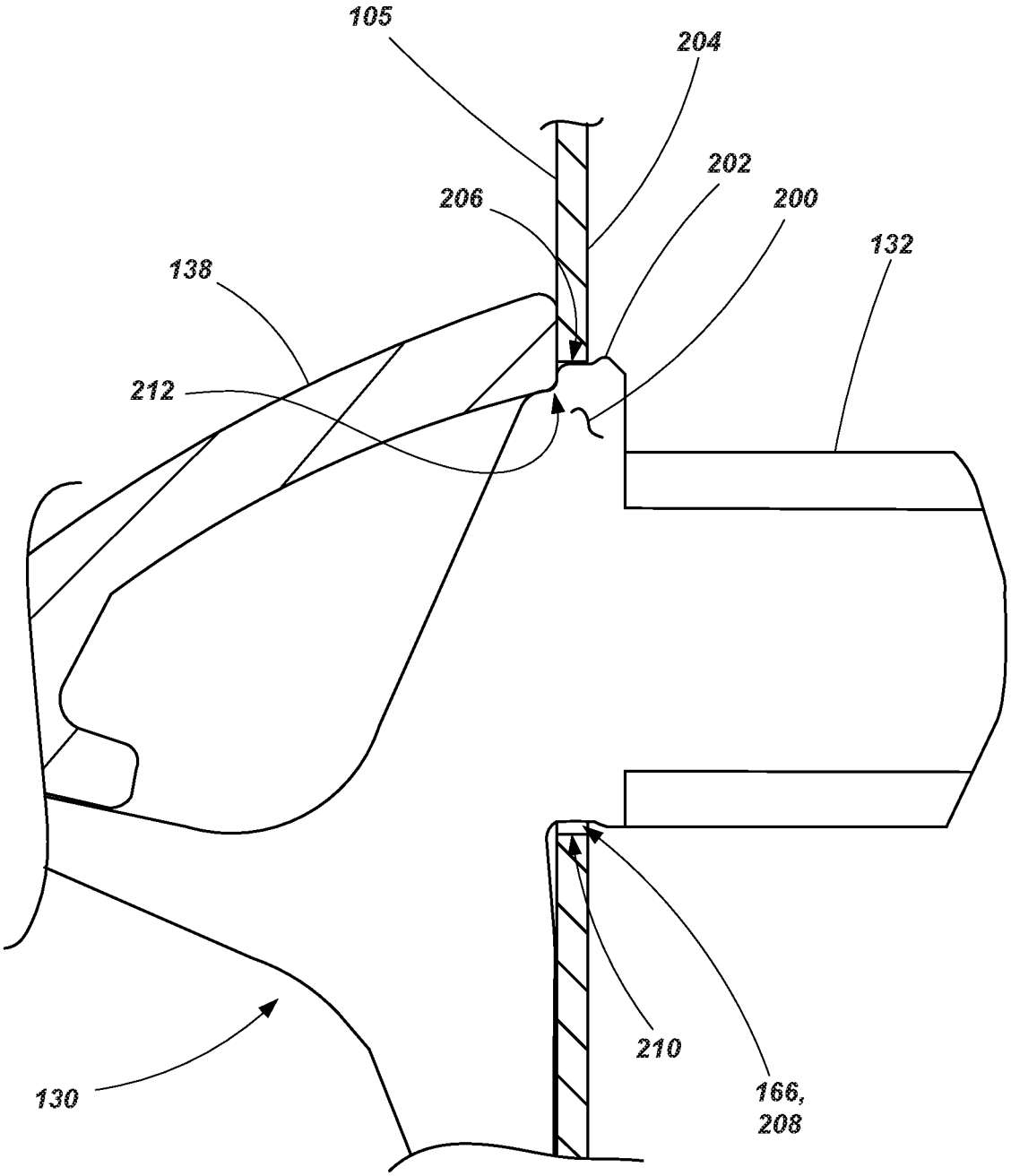
FIG. 8 is an enlarged portion of the view shown in FIG. 6.
Figure 9:
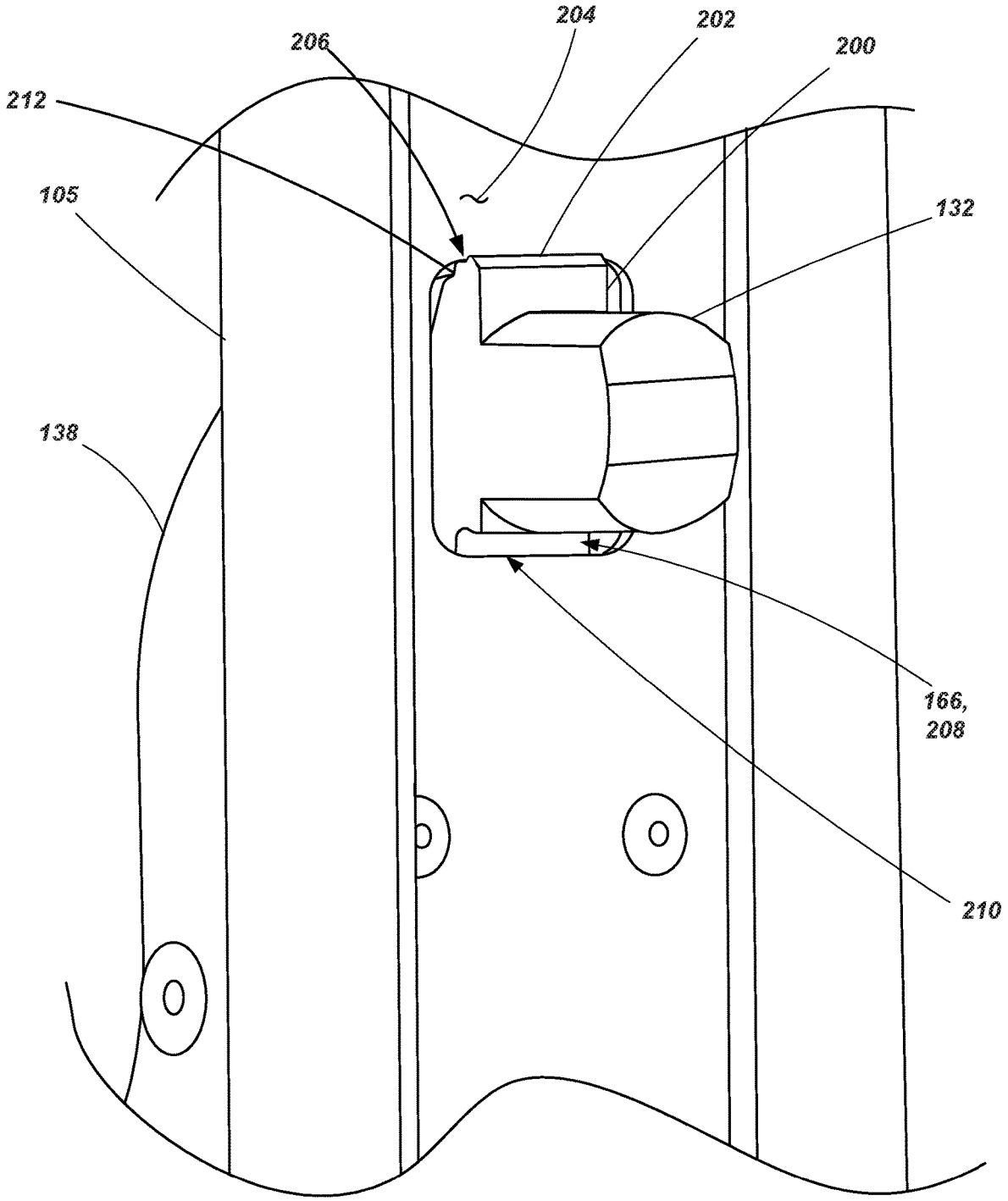
FIG. 9 is a perspective view of the adjustment mechanism shown in FIG. 6.

Referring briefly to FIGS. 8 and 9, enlarged views are shown of the engagement pin 130 as it engages the opening 166 of the outer rail 105. In the embodiment shown in FIGS. 8 and 9, an upper shoulder 200 is positioned adjacent the engagement portion 132 and includes features configured to engage an associated opening 166 of the outer rail 105 and to engage the lever 138. For example, a protruding edge 202, which may extend substantially across a width of the shoulder 200, may be configured such that, when the locking mechanism 104 is in the first position (as shown in both FIGS. 8 and 9 and as discussed above), the protruding edge 202 extends upward along an inner side 204 of the outer rail 105, interfering with the edge 206 of the opening 166. This protruding edge 202, or interference lip, helps to maintain the locking mechanism 104 in the first position (i.e., a locked or engaged state) when the ladder is in orientation of intended use. It has been determined that the protruding edge 202 provides protection against inadvertent actuation of the locking mechanism (from the first position to the second position) by an accidental blow or striking of the lever by a tool or falling object as may occur during the use of the ladder.

A small area of clearance 208 may be formed between the lower edge of the engagement portion 132 and the lower edge 210 of the opening to help facilitate the engagement and disengagement of the engagement pin 130 with the opening 166 in light of the protruding edge 202.

It is also noted that a recessed portion 212 is spaced from, but positioned near the protruding edge 202. In the embodiment shown, the recessed portion 212 may include a rounded channel extending substantially across the shoulder 200 which may extend substantially parallel to the protruding edge 202. A portion of the lever 138 (e.g., an inner portion of the upper section such as seen in FIG. 8) may abut and engage the recessed portion 210 when the locking mechanism 104 is in the first position. The spring 142 biases the lever 138 into engagement with the recessed portion 212 to apply direct pressure to the shoulder portion 200 of the engagement pin 130 when in the first position, helping to maintain the locking mechanism in a locked or engaged state until adequate pressure is applied to the lower portion of the lever 138 by a user with the intention of actuating the locking mechanism 104.

As seen in the drawings, the engagement portion 132 may also include features, including a rounded or chamfered face, rounded or chamfered sides, and the like, to improve its interaction with the various openings that it engages and disengages.

While the operation of the locking mechanism 104 is described above as a squeezing action by the user, other means of operating the locking mechanism may be employed. For example, a user may strike the lower portion of the lever 138 with a quick blow of sufficient force to displace it from the first position to the second position. Reengagement may be likewise accomplished.

The embodiments of the locking mechanism of the present disclosure provide a number of advantages over prior art mechanisms including robust design, ease of use with a reduced number of components, and ease of manufacturing to name a few. For example, assembly of the locking mechanism is relatively simple in that the bracket is fastened to the outer rail, the detent mechanism is assembled to the lever or handle, the engagement pin is inserted into the bracket, the biasing member/spring is placed between the engagement pin and the lever, the lever is positioned in place and the pivot member (e.g., a mechanical fastener) is put in place to retain the mechanism in its assembled condition.

The various components may be made of a variety of materials including plastics, metals, metal alloys and other appropriate materials. In one embodiment, the lever or handle may be formed of a plastic material while the engagement pin and brackets are formed of metal or metal alloy materials. Of course, other combinations of materials are also contemplated.

While embodiments described above have been in terms of an adjustable height step ladder, the locking mechanisms described herein may be used in other types of ladders including, for example, so-called articulating or combination ladders. One example of an articulating ladder in which such a locking mechanism may be incorporated is described in U.S. Pat. No. 9,016,434, entitled LADDERS, LADDER COMPONENTS AND RELATED METHODS, issued on Apr. 28, 2015, the disclosure of which is incorporated herein in its entirety.

While the invention may be susceptible to various modifications and alternative forms, specific embodiments have been shown by way of example in the drawings and have been described in detail herein. However, it should be understood that the invention is not intended to be limited to the particular forms disclosed. Rather, the invention includes all modifications, equivalents, and alternatives falling within the spirit and scope of the invention as defined by the following appended claims.

What is claimed is:

1. A ladder comprising:

a first assembly having a pair of inner rails and a pair of outer rails, the pair of inner rails being slidably coupled with the pair of outer rails; and at least one locking mechanism comprising:

a bracket coupled with an outer side of a first outer rail of the pair of outer rails, a lever pivotally coupled with the bracket, an engagement pin coupled with the lever and having an engagement portion sized and configured to engage an opening formed in the first outer rail and an aligned opening formed in a first inner rail of the pair of rails, wherein the engagement pin includes an upper shoulder positioned adjacent the engagement portion and an interference lip positioned on the shoulder, wherein when the lever is in a first position, the interference lip extends longitudinally along an inner side of the first outer rail, the inner side being opposite the outer side.

2. The ladder of claim 1, further comprising a recess formed in the shoulder, wherein the lever engages the recessed portion when the lever is in the first position.

3. The ladder of claim 1, wherein the at least one locking mechanism further comprises:

a biasing member biasing the lever towards the first position, and a detent mechanism.

4. The ladder of claim 1, further comprising at least one rung coupled between the pair of inner rails and at least one rung coupled between the pair of outer rails.

5. The ladder of claim 1, wherein the at least one locking mechanism includes a first locking mechanism associated with the first outer rail of the pair of outer rails and a second locking mechanism associated with a second outer rail of the pair of outer rails.

6. The ladder of claim 1, wherein the lever pivots relative to the bracket about a first axis and wherein the engagement pin pivots about a second axis relative to the bracket.

7. The ladder of claim 6, wherein the first axis and the second axis are parallel to one another.

8. The ladder of claim 1, wherein the lever is pivotally coupled with the bracket at a first pivot point and the engagement pin is pivotally coupled with the bracket at a second pivot point.

9. The ladder of claim 8, wherein the second pivot point is positioned closer to the first outer rail than the first pivot point.

10. The ladder of claim 9, wherein the first pivot point is at an upper portion of the bracket and the second pivot point is at a lower portion of the bracket.

11. A ladder comprising:

a first assembly having a pair of inner rails and a pair of outer rails, the pair of inner rails being slidably coupled with the pair of outer rails; and at least one locking mechanism comprising:

a bracket coupled with a first outer rail of the pair of outer rails, a lever pivotally coupled with the bracket, an engagement pin coupled with the lever and having an engagement portion sized and configured to engage an opening formed in the first outer rail and an aligned opening formed in a first inner rail of the pair of rails, wherein the engagement pin includes an upper shoulder positioned adjacent the engagement portion and an interference lip positioned on the shoulder, wherein when the lever is in a first position, the interference lip extends upward along an inner side of the first outer rail; and a clearance gap formed between the engagement portion of the pin and a lower edge of the opening in the first outer rail.

12. A ladder comprising:

a first assembly having a pair of inner rails and a pair of outer rails, the pair of inner rails being slidably coupled with the pair of outer rails; and at least one locking mechanism comprising:

a bracket coupled with a first outer rail of the pair of outer rails, a lever pivotally coupled with the bracket, an engagement pin coupled with the lever and having an engagement portion sized and configured to engage an opening formed in the first outer rail and an aligned opening formed in a first inner rail of the pair of rails, wherein the engagement pin includes an upper shoulder positioned adjacent the engagement portion and an interference lip positioned on the shoulder, wherein when the lever is in a first position, the interference lip extends upward along an inner side of the first outer rail, a biasing member biasing the lever towards the first position, and a detent mechanism including:

a slider body slidably disposed in a detent pocket formed within an interior portion of the lever;

a detent spring disposed within the detent pocket and biasing the slider body in a first direction; and a detent groove formed in a portion of the bracket, wherein when the lever is pivoted to a second position relative to the bracket, a portion of the slider body is biased into engagement with the detent groove by the detent spring such that the lever is maintained in the second position until a predetermined force is applied to a specified portion of the lever.

13. The ladder of claim 12, wherein the engagement pin further includes a lever portion extending downward from the engagement portion, the lever portion including a grooved surface, the grooved surface of the lever portion pivotally engaging a pivot structure of the bracket.

14. The ladder of claim 13, wherein the engagement pin further includes a hook portion extending away from the engagement portion, the hook portion engaging a portion of the lever.

15. The ladder of claim 14, further comprising a retaining plate coupled with the lever adjacent the slider body, the retaining plate located and configured to retain the slider body within the detent pocket.

16. The ladder of claim 15, further comprising a pivot pin coupling the lever to the bracket.

* * * * *